United States Patent [19]

Osaki et al.

[11] Patent Number: 4,527,518

[45] Date of Patent: Jul. 9, 1985

[54] INTERNAL COMBUSTION ENGINE HAVING SINGLE OVERHEAD CAMSHAFT

[75] Inventors: Kiyoshi Osaki; Yutaka Koinuma, both of Saitama, Japan

[73] Assignee: Honda Giken Kogyo Kabushiki Kaisha, Tokyo, Japan

[21] Appl. No.: 627,928

[22] Filed: Jul. 5, 1984

[30] Foreign Application Priority Data

Jul. 5, 1983 [JP] Japan ..... 58-122199
Jul. 5, 1983 [JP] Japan ..... 58-122200
Aug. 5, 1983 [JP] Japan ..... 58-143428

[51] Int. Cl.[3] ..... F01L 1/26
[52] U.S. Cl. ..... 123/90.23; 123/432
[58] Field of Search ..... 123/90.23, 432, 308

[56] References Cited

FOREIGN PATENT DOCUMENTS 162019 12/1979 Japan ..... 123/432
695546 8/1953 United Kingdom ..... 123/90.23

*Primary Examiner*—E. Rollins Cross
*Attorney, Agent, or Firm*—Lyon & Lyon

[57] ABSTRACT

An internal combustion engine which includes an engine block in the shape of a V having a cylinder, a piston reciprocally mounted on the cylinder and a cylinder head having a combustion chamber has a spark plug positioned in the cylinder head at about the axis of the cylinder. In the preferred embodiment two intake valves and two exhaust valves are positioned in the cylinder head for each cylinder with the valve stems extending upwardly from the cylinder and spaced on opposite sides of the spark plug. The two intake and two exhaust valves are opened by a single camshaft positioned above the cylinder head. A push rod means, a first cam follower means, a second cam follower means and a rocker arm means are positioned in the cylinder head to open each intake and exhaust valves. In one form of the preferred embodiment the single camshaft is positioned adjacent the intake valve stem offset towards the center of the V. In another form of the preferred embodiment valve end space adjacent means are provided for each valve and in still another form of the preferred embodiment the valve end space adjacent means include hydraulic tappet means. An alternative embodiment utilizes only one intake and one exhaust valve for each cylinder.

20 Claims, 7 Drawing Figures

INTERNAL COMBUSTION ENGINE HAVING SINGLE OVERHEAD CAMSHAFT

BACKGROUND OF THE INVENTION

The field of the present invention is an internal combustion engine and particularly an internal combustion engine having a single overhead camshaft.

Internal combustion engines may utilize overhead valves. In these engines each cylinder typically has an intake valve and an exhaust valve. The engine may utilize a single camshaft to operate both the intake and exhaust valve such as disclosed in U.S. Pat. Nos. 3,353,523, 3,306,271 and in FIG. 48 of U.S. Pat. No. 3,316,890. The engine may also utilize two camshafts, a first camshaft to operate the intake valve and a second camshaft to operate the exhaust valve such as disclosed in FIG. 47 of U.S. Pat. No. 3,316,890.

One camshaft centered between the valves can activate both the intake valve and the exhaust valve. But when the camshaft is centered it is difficult to position the engine spark plug axially in line with the cylinder axis. The use of two camshafts permits axially positioning of the spark plug but it requires a complex timing mechanism to drive the two camshafts from the crankshaft. The use of a second camshaft and associated timing mechanism also requires mounting space which increases the size of the engine, the weight of the engine and the cost of the engine.

SUMMARY OF THE INVENTION

The present invention is directed to an internal combustion engine including an engine block in the shape of a V having a cylinder, a piston reciprocally mounted in the cylinder and a cylinder head having a combustion chamber.

The engine has a spark plug positioned in the cylinder head at about the axis of the cylinder. An intake valve and an exhaust valve for each cylinder is positioned in the cylinder head with the valve stems extending upwardly from the cylinder and spaced on opposite sides of the spark plug. A single camshaft including a cam for opening the intake valve and a cam for opening the exhaust valve is positioned above the cylinder head.

The engine also includes a push rod means, a first cam follower means positioned between a cam and the stem end of one of the intake and exhaust valves, a second cam follower means positioned between a cam and a first end of the push rod and a rocker arm means positioned between a second end of said push rod and the stem end of the other one of the intake and exhaust valve.

In applicant's novel internal combustion engine the intake and exhaust valves are opened by a single camshaft. The unique intake valve operating means and exhaust valve operating means provided above the valves eliminates the need for a complex timing mechanism to drive two camshafts, eliminates the mounting of the timing mechanism and the second camshaft and eliminates the space requirement for the timing mechanism and second camshaft thereby permiting a more compact engine at a lower weight and reduced cost.

DETAILED DESCRIPTION OF THE PREFERRED EMBODIMENT

Figure 1:
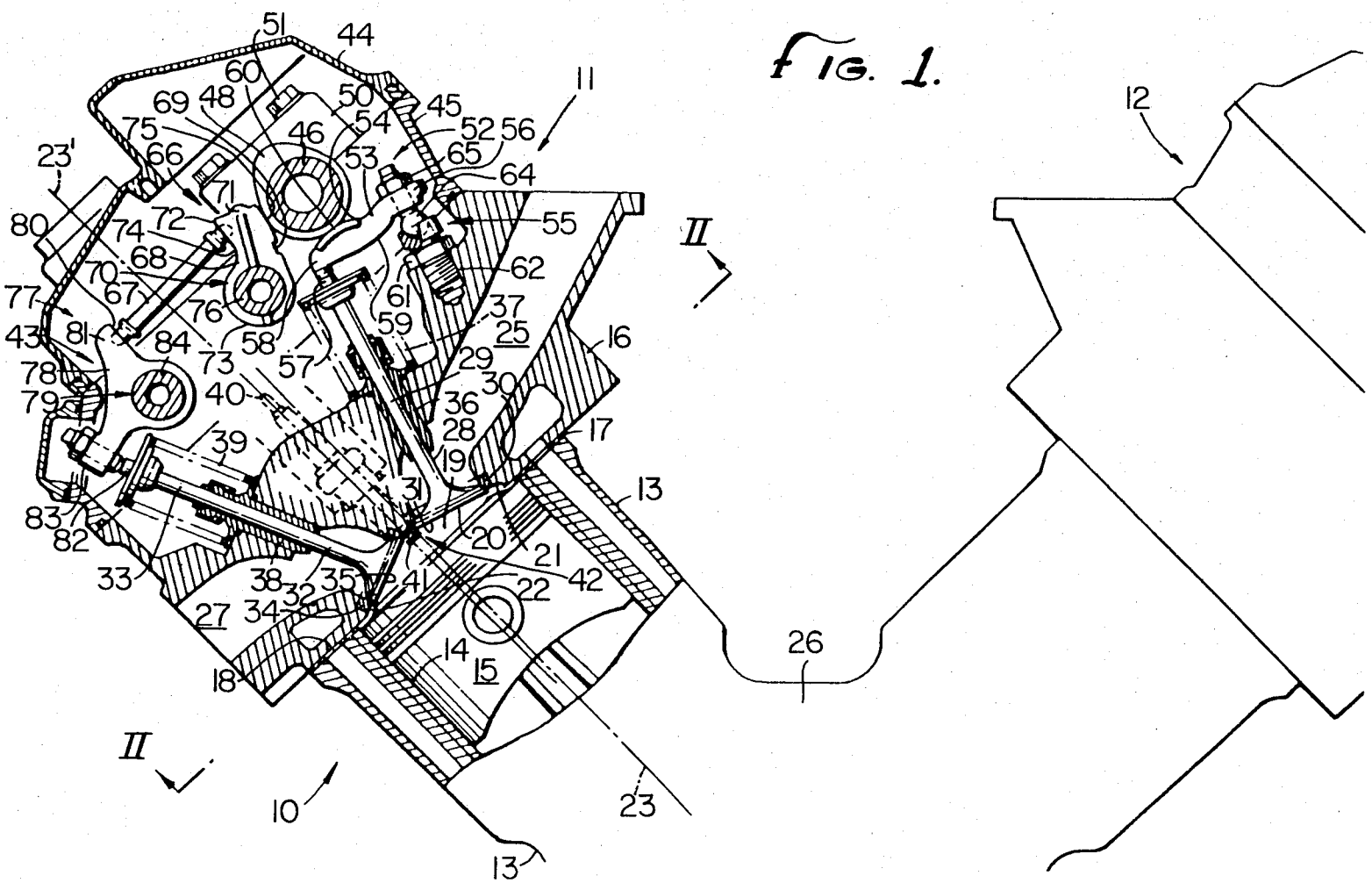
FIG. 1 is the first embodiment of the internal combustion engine of the invention shown in partial cross section.
Figure 4:
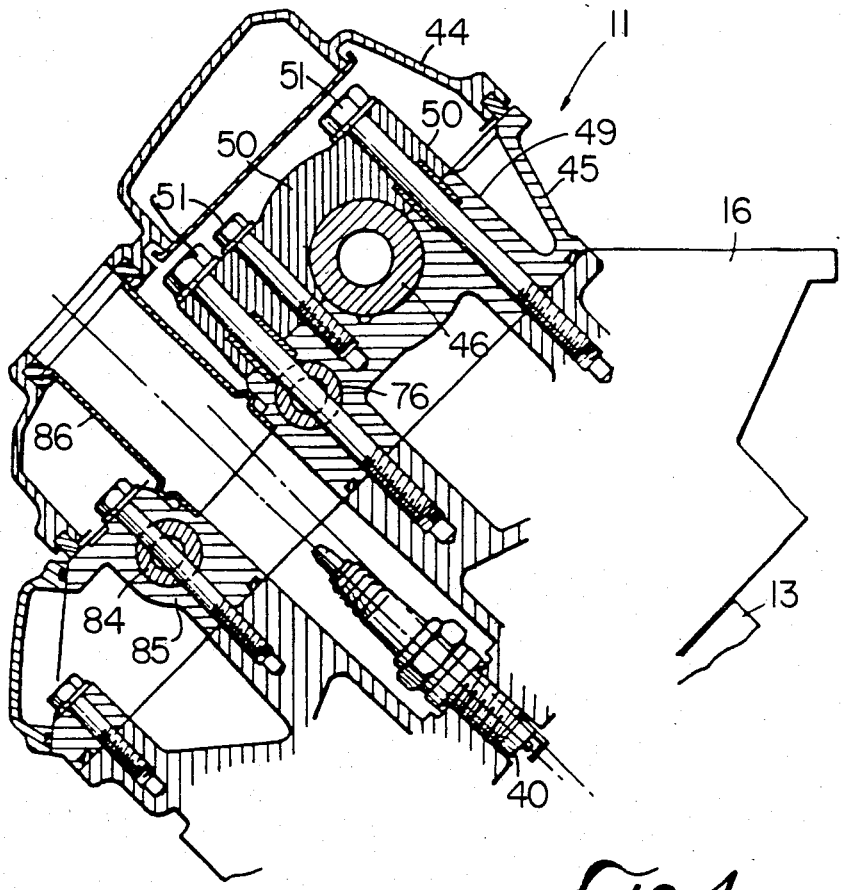
FIG. 4 is a partial sectional view of the cylinder head shown in FIG. 3 on line 4—4.
Figure 3:
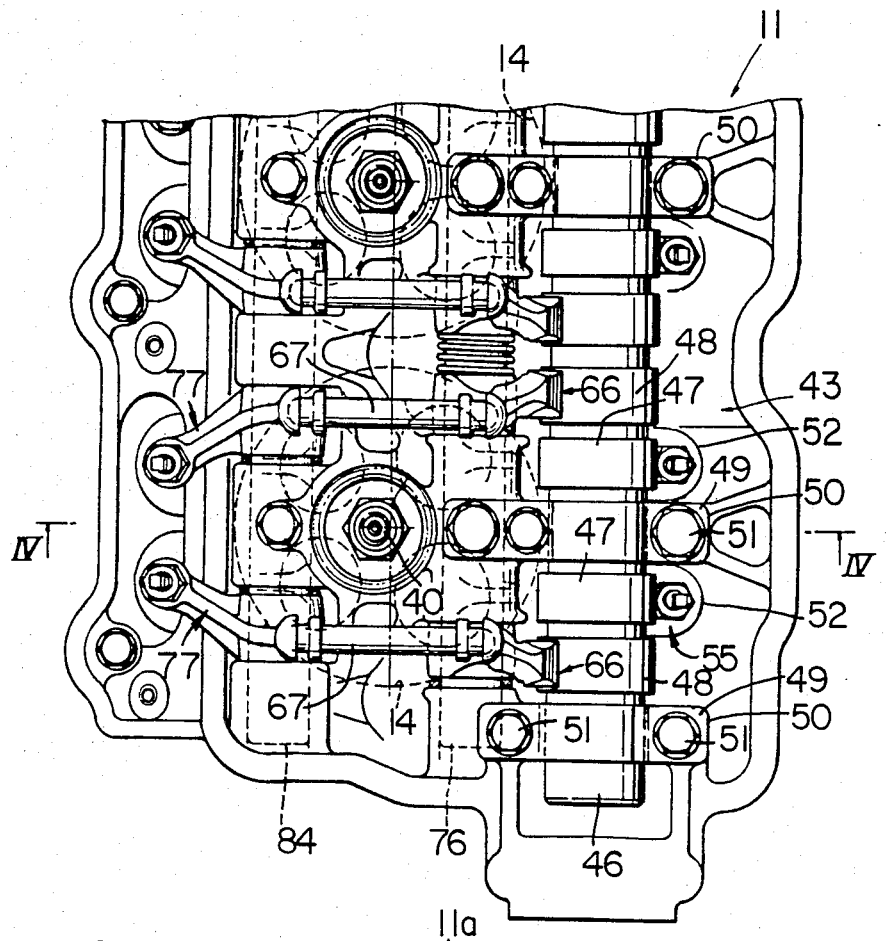
FIG. 3 is a partial plan view of the cylinder head for the engine of FIG. 1.

A first embodiment of a multicylinder internal combustion engine 10 is illustrated in FIGS. 1, 3 and 4. The engine 10 includes a first cylinder row or bank 11 and a second cylinder row or bank 12. The cylinder bank 11 is symmetrical with the cylinder bank 12 and they each include at least one cylinder. The engine block 10 has the shape of a V with each of the cylinder banks 11 and 12 forming the opposite sides of the V.

The engine 10 includes an engine block 13 having a cylinder 14 and a piston 15 reciprocally mounted in the cylinder of the engine block 13.

Figure 2:
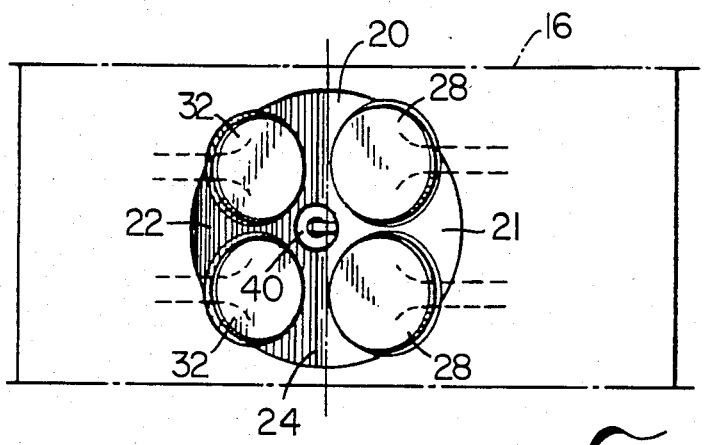
FIG. 2 is a partial view of the combustion chamber for the engine of FIG. 1 shown on line 2—2.

The cylinder head 16 is mounted with a cylinder head gasket 17 against the top face 18 of the engine block as shown in FIG. 1. A combustion chamber 19 is defined in the cylinder head 16 above the piston 15. The combustion chamber 19 has a top surface 20 which includes a first angled surface 21 and a second angled surface 22. Referring to FIG. 2, the angled surfaces 21 and 22 are symmetrical to the axis 23 of the cylinder 14 and symmetrical to a ridge line 24.

The cylinder head 16 includes two intake passageways 25 entering from the center 26 of the V and two exhaust passageways 27 exiting from the outside of the V. The intake passageways 25 open into the combustion chamber 19 on the first angled surface 21 and the exhaust passageways 27 exit from the combustion chamber 19 on the second angled surface 22.

Two intake valves 28 are positioned in the cylinder head 16 to open and close the intake passageways 25. The intake valves 28 each include an intake valve stem 29 extending upwardly from the cylinder head 16, an intake valve seat 30 sealing each of the closed intake passageways 25 and an intake valve end surface 31 generally defining and conforming to the first angled surface 21. Two exhaust valves 32 are also positioned in the cylinder head 16 to open and close the exhaust passageways 27. The exhaust valves 32 each include an exhaust valve stem 33 extending upwardly from the cylinder head 16, an exhaust valve seat 34 sealing each of the closed exhaust passageways 27 and an exhaust valve end surface 35 generally defining and conforming to the second angled surface 22. The two intake valve stems 29 are slidably mounted in intake valve guides 36 and the two intake valves 28 are each held closed by intake valve springs 37. The two exhaust valve stems 33 are each slidably mounted in exhaust valve guides 38 and they are each held closed by exhaust valve springs 39.

A spark plug 40 is threadably mounted in the cylinder head 16 at about the cylinder axis 23 with the spark plug electrode 41 positioned at about the top center 42 of the combustion chamber 19 with the intake valve 28 and exhaust valve 32 on opposite sides. The spark plug 40 is symmetrically surrounded by the intake valve end surfaces 31 and exhaust valve end surfaces 35. (Shown in FIG. 2). In the preferred embodiment the spark plug center is slightly offset from the cylinder axis 23 on spark plug axis 23' as shown in FIGS. 1 and 2. The positioning of the spark plug electrode 41 or ignition point at about the top center 42 of the combustion chamber 19 creates generally equal distances from the ignition point to the circumferential edges of the combustion chamber 19. This provides for short and substantially uniform ignition flame propagation distance thereby reducing combustion time. This results in an increased engine output power.

A valve operating means 43 is generally positioned on the upper side of the cylinder head 16 adjacent the intake and exhaust valve stems 29 and 33. The valve operating means 43 is sealably enclosed within the cylinder head 16 by a top valve cover 44 and a side valve cover 45.

The valve operating means 43 includes a single camshaft 46 positioned longitudinally in the cylinder head 16 along the first or second cylinder banks 11 and 12. The camshaft 46 includes two intake valve cams 47 for opening the two intake valves 28 and two exhaust valve cams 48 for opening the two exhaust valves 32. In the embodiment shown in FIGS. 1 through 4 the camshaft 46 is positioned adjacent the ends of the intake valve stems 29 and offset towards the center 26 of the V. The offset of the camshaft 46 reduces the width of each of the cylinder banks 11 and 12 thereby reducing the outside dimensions of the engine 10.

The camshaft 46 is mounted parallel to a crankshaft (not shown) and driven by a timing mechanism (not shown) as is known. The camshaft 46 is mounted on the cylinder head 16 on journals or bearing supports 49. The bearing supports 49 are formed as a part of the cylinder head 16. Each of the bearing supports 49 include a bearing cap 50 which is fastened to the bearing supports 49 by bolts 51. One of the bearing supports 49 is positioned in line with the cylinder axis 23 as shown in FIGS. 1 and 3. This permits symmetrical positioning of the intake cams 47 and exhaust cams 48 on both sides of the bearing support 49 as shown in FIG. 3.

Referring to FIG. 3 there is shown two intake cams 47 positioned adjacent and on opposite sides of the bearing support 49 and two exhaust cams 48, each also positioned on opposite sides of the bearing support 49 and spaced from the bearing support 49 by the two intake cams 47.

A first cam follower means 52 is operably positioned between the surface of an intake valve cam 47 and the end of an intake valve stem 29. The preferred first cam follower means 52 is a lever 53 having a first side 54 with a first fulcrum support means 55 at one end 56 and a valve stem contact surface 57 at the other end 58 and having a second side 59 with a cam contact surface 60 in contact with the intake valve cam 47. The first fulcrum support means 55 includes a support bolt 61 having one end 62 threaded into the cylinder head 16, and valve end space adjustment means 63. The valve end space adjustment means 63 is an adjustment bolt 64 with locking nut 65.

A second cam follower means 66 is operably positioned between the surface of an exhaust valve cam 48 and a push rod 67. The preferred second cam follower means 66 with a second lever 68 having a first side 74 with a second fulcrum support means 70 at one end 73 and a push rod contact surface 72 at the other end 71 and having a second side 69 with a cam contact surface 75 in contact with an exhaust cam 48. The second fulcrum support means 70 as best shown in FIGS. 1 and 3 is a fulcrum shaft 76 mounted in the cylinder head 16.

A rocker arm means 77 is positioned between an exhaust valve 32 and the push rod 67. The preferred rocker arm means 77 includes an L-shaped rocker arm lever 78. The lever 78 is mounted on a third fulcrum support means 79 and includes a push rod contact surface 80 at one end 81 and an exhaust valve stem contact surface with valve space adjustment means 82 at the other end 83. The third fulcrum support means 79 is a shaft 84 mounted in the cylinder head 16.

The fulcrum shafts 76 and 84 are mounted in the cylinder head 16 on bearing supports 85. In one form of the preferred embodiment of FIG. 1 the shafts 76 and 84 are positioned between the two intake valves 28 and the two exhaust valves 32, spaced apart on opposite sides of the cylinder axis 23 and parallel to the camshaft 46.

The top valve cover 44 includes walled passageway 86 for installation and removal of the spark plug 40. The walled passageway 86 is positioned between the fulcrum shafts 76 and 84 and sealably extends between the cylinder head 16 and the top of the valve cover 44.

During operation of the internal combustion engine 10 the camshaft 46 is rotated in a timed relationship to the reciprocating cycles of the piston 15. When the piston 15 is starting an intake cycle the intake valve cam 47 pivots the first cam follower lever 53 about fulcrum support means 55 which in turn forces the intake valve stem contact surface 57 against the end of the intake valve 28 to open the intake valve 28. With the intake valve 28 open fresh fuel-air mixture flows through the intake passageway 25 into the combustion chamber 19. At the end of the intake stroke the cam 47 further rotates to permit the intake valve spring 37 to return the intake valve 28 to its closed position.

When the piston 15 is completing the compression cycle, the compressed air-fuel mixture is ignited by the spark plug 40 thereby starting the firing cycle. During this time both the intake valve 28 and the exhaust valve 34 are closed.

When the piston 15 is starting the exhaust cycle the exhaust cam 48 pivots the second cam follower lever 68 about the fulcrum shaft 76 which in turn pushes on the push rod 67 which in turn pivots the rocker arm means 77 which in turn pushes on the end of the exhaust valve stem 33 to open the exhaust valve 32. With the exhaust valve 32 open the exhaust gases flow from the combustion chamber 19 out the exhaust passageway 27.

Figure 7:
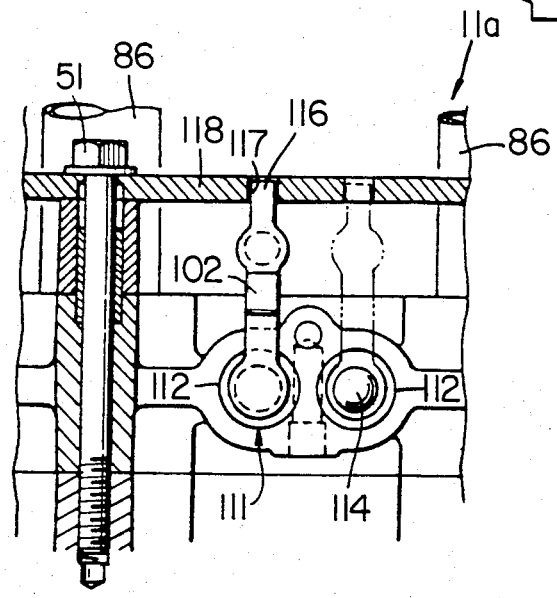
FIG. 7 is a partial sectional view of the cylinder head shown in FIG. 6 on line 7—7.
Figure 5:
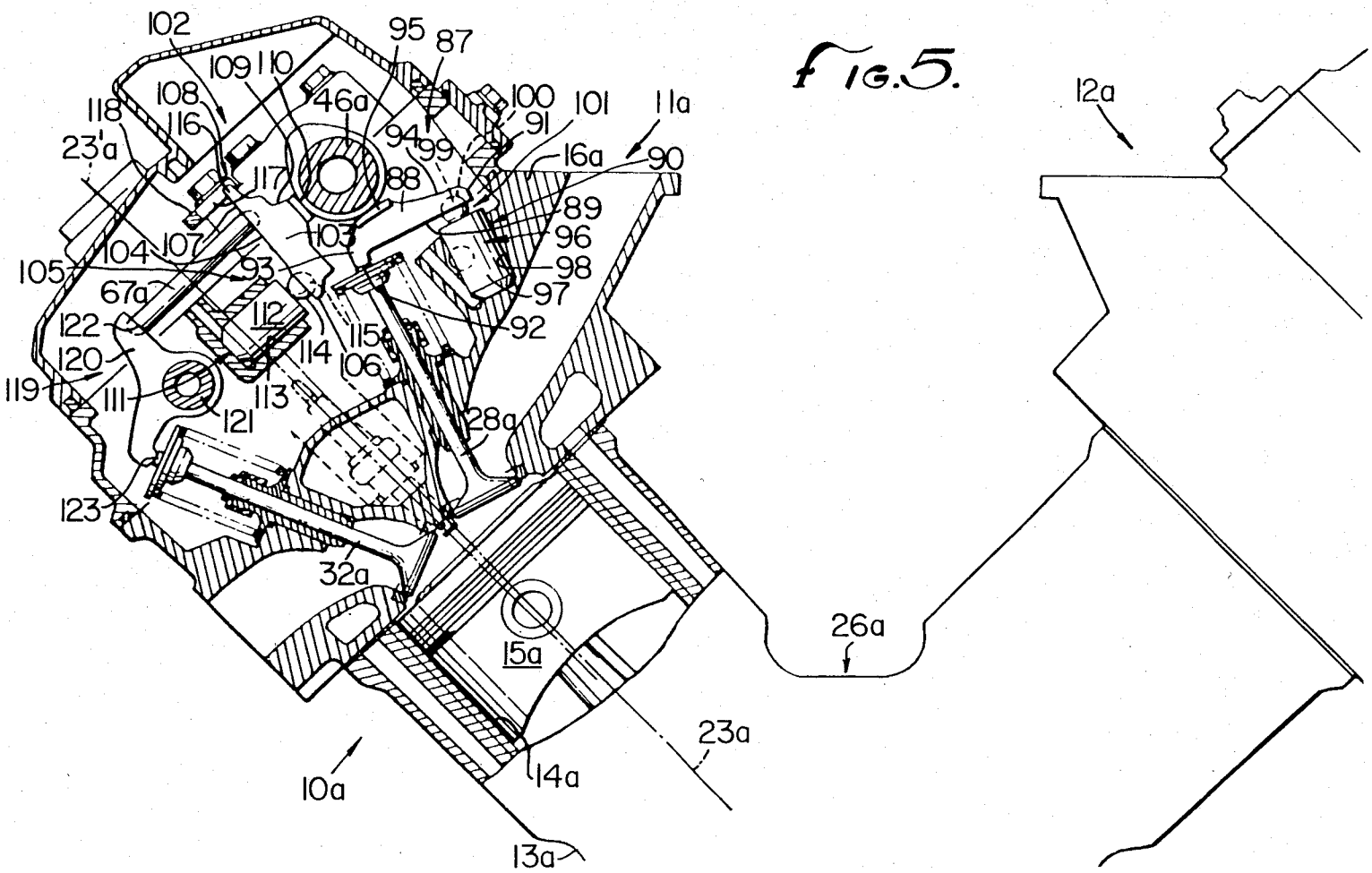
FIG. 5 is a second embodiment of the internal combustion engine.
Figure 6:
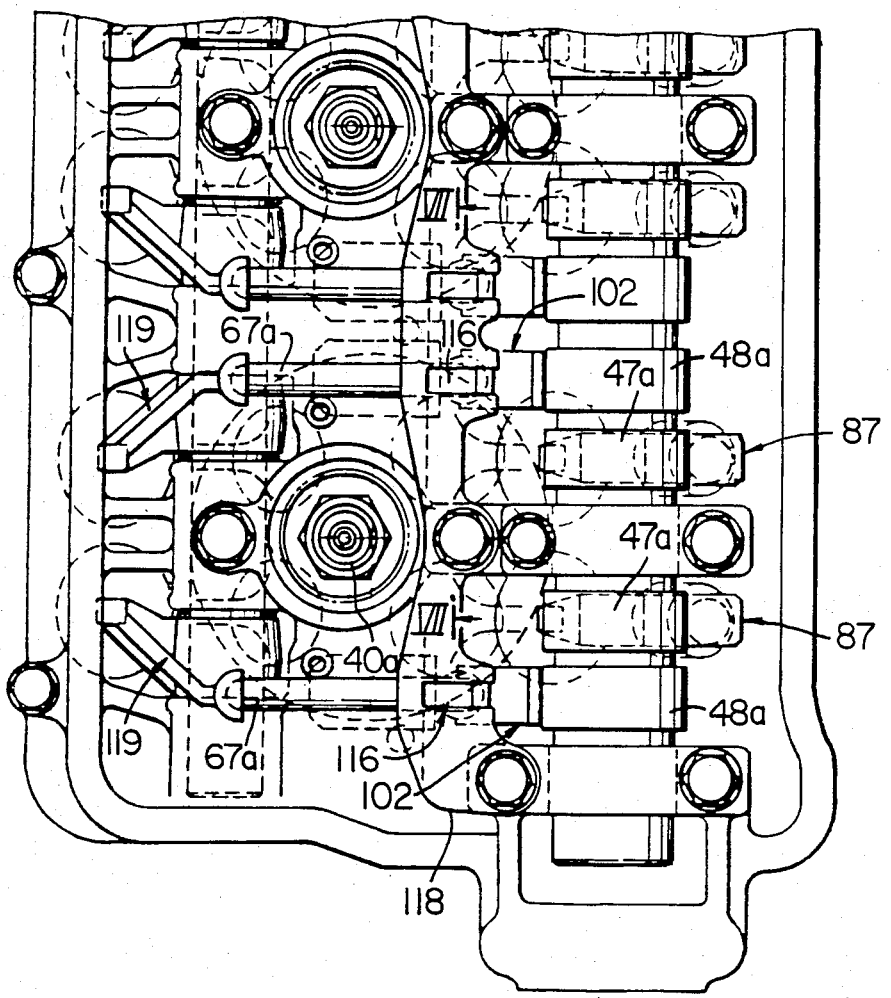
FIG. 6 is a partial plan view of the cylinder head for the engine of FIG. 5.

FIGS. 5 through 7 illustrate a second embodiment of an internal combustion engine **10*a*. The engine 10*a* is substantially similar to engine 10 except as will be described. Reference numbers used for the engine 10** are referred to in the second embodiment with the suffix "a".

Referring to FIGS. 5 and 6, valve operating means **43*a* include a camshaft 46*a*. A first cam follower means 87 is operably positioned between the surface of an intake valve cam 47*a* and the end of an intake valve stem 29*a*. The preferred first cam follower means 87 is a lever 88 having a first side 89 with a first fulcrum support means 90 at one end 91 and a valve stem contact surface 92 at the other end 93 and having a second side 94 with a cam contact surface 95 in contact with the intake valve cam 47*a*. The first fulcrum support means 90 includes a hydraulic tappet means 96. The hydraulic tappet means 96 includes a hydraulic tappet 97 positioned in a tappet hole 98 formed in the cylinder head 16***a*. The hydraulic tappet means 96 has a fulcrum ball member 99 which fits into a socket like depression 100 at end 91 of lever 88. The hydraulic tappet means 96 includes valve stem end adjustment means 101.

A second cam follower means 102 is operably positioned between the surface of an exhaust valve cam 48*a* and a push rod 67*a*. The second cam follower means 102 is a second lever 103 having a first side 104 with a second fulcrum support means 105 at one end 106 and a push rod contact surface 107 at the other end 108 and having a second side 109 with a cam contact surface 110 in contact with an exhaust cam 48*a*. The second fulcrum support means 105 as best shown in FIG. 5 is a hydraulic tappet means 111. The hydraulic tappet means 111 includes a hydraulic tappet 112 positioned in a tappet hole 113 formed in the cylinder head 16*a*. The hydraulic tappet means 111 has a fulcrum ball member 114 which fits into a socket like depression 115 at end 106 of lever 103. The second cam follower means 102 also includes a guide means 116 at the other end 108 of the lever 103 slidably engaging with a guide groove 117 in the cylinder head 16*a*. The guide groove 117 is formed in a guide plate 118 which is mounted to the cylinder head 16*a* as shown in FIG. 7.

A rocker arm means 119 is positioned between an exhaust valve 32*a* and the push rod 67*a*. The rocker arm means 119 includes an L-shaped rocker arm lever 120. The lever 120 is mounted on a third fulcrum support means 121 and includes a push rod contact surface 122 and an exhaust valve stem contact surface 123.

The engine 10*a* operates as previously described for the engine 10 except for the hydraulic tappet means used with the intake and exhaust valves.

During the intake cycle the intake valve cam 47*a* pivots the first cam follower lever 88 about the first fulcrum support means 90 which in turn forces the intake valve stem contact surface 57*a* against the end of the intake valve 28*a* to open the intake valve 28*a*. During the exhaust cycle the exhaust cam 48*a* pivots the second cam follower lever 103 about the second fulcrum support means 105 which in turn pivots the rocker arm lever 120 which in turn pushes on the end of the exhaust valve stem 33*a* to open the exhaust valve 32*a*. Rotation of the camshaft 46*a* opens and closes the intake and exhaust valves during the operation of the engine 10*a*. In the second embodiment the hydraulic tappet means 96 and 111 fill with oil to adjust the valve stem end space.

The engines 10 or 10*a* may have only one intake valve and one exhaust valve for each cylinder, if desired. Such an engine also only has one exhaust cam, one intake cam and one each intake and exhaust valve operating means for each cylinder. Where desirable the intake valve and exhaust valve positions can be interchanged.

While the invention has been described in connection with a V-type engine, it will readily appear to those skilled in the art that the principles of this invention may also be applied advantageously to an in-line type engine having all the cylinders arranged in a single line.

We claim:

1. An internal combustion engine including an engine block having a cylinder, a piston reciprocally mounted in the cylinder and a cylinder head having a combustion chamber, comprising, a spark plug positioned in the cylinder head at about the axis of the cylinder, an intake valve and an exhaust valve positioned in the cylinder head with the valve stems extending upwardly from the cylinder and spaced on opposite sides of said spark plug, a single camshaft including a cam for opening said intake valve and a cam for opening said exhaust valve, a push rod means, a first cam follower means positioned between a cam and the stem end of one of said intake and exhaust valves a second cam follower means positioned between a cam and a first end of said push rod means, and a rocker arm means positioned between a second end of said push rod and the stem end of the other one of said intake and exhaust valve.

2. The engine defined in claim 1 wherein two banks of cylinders are arranged in a V, said intake valve is on the side of the cylinder towards the center of the V, and said camshaft is positioned adjacent the stem end of said intake valve and offset from said intake valve towards the center of the V.

3. The engine defined in claim 1 wherein said first cam follower means is a lever having a first side with a fulcrum support means at one end and a valve stem contact surface at the other end and having a second side with a cam contact surface.

4. The engine defined in claim 3 wherein said fulcrum support for said first cam follower means includes a valve end space adjustment means.

5. The engine defined in claim 4 wherein said valve end space adjustment means is a thread adjustment means.

6. The engine defined in claim 4 wherein said valve end space adjustment means is a hydraulic tappet adjustment means.

7. The engine defined in claim 1 wherein said second cam follower contact means is a lever having a first side with a fulcrum support means at one end and a push rod contact surface at the other end and a second side having a cam contact surface.

8. The engine defined in claim 7 wherein said end space adjustment means is a hydraulic tappet adjustment means.

9. The engine defined in claim 7 wherein said fulcrum support means is a fulcrum shaft means.

10. The engine defined in claim 1 wherein said rocker arm means includes a fulcrum shaft, a L-shaped rocker arm mounted on said fulcrum shaft, a push rod contact surface at one end of said rocker arm and a valve stem contact surface at the other end of said rocker arm.

11. The engine defined in claim 10 wherein said valve stem contact surface includes a valve end space adjustment means.

12. The engine defined in claim 1 wherein said engine further comprises a bearing support for said camshaft and the exhaust valve cam is positioned adjacent one side of said support bearing and the intake valve cam is positioned adjacent the other said of said support bearing.

13. The engine defined in claim 1 comprising two intake valves and two exhaust valves for each cylinder.

14. The engine defined in claim 13 wherein said engine further comprises a bearing support for said camshaft, two exhaust valve cams, each exhaust valve cam positioned on opposite sides of said bearing support, and two intake valve cams, each intake valve cam positioned on opposite sides of said bearing support spaced from said bearing support by said exhaust valve cams.

15. The engine defined in claim 13 wherein said engine further comprises a bearing support for said camshaft, two intake valve cams, each intake valve cam positioned on opposite sides of said bearing support and two exhaust valve cams, each exhaust valve cam positioned on opposite sides of said bearing support spaced from said bearing support by said intake valve cams.

16. The engine defined in claim 1 wherein said second cam follower means includes a first fulcrum pivot shaft means and said rocker arm means includes a second fulcrum pivot shaft means, said first and second pivot shaft means being positioned in said engine parallel to said camshaft.

17. An internal combustion engine including an engine block having a cylinder bore and an exhaust passageway opposite an intake passageway comprising a spark plug positioned on about the axis of the cylinder bore, a single camshaft having two intake cams and two exhaust cams, two intake valves on one cylinder positioned to open into said intake passageway at one side of said camshaft two exhaust valves on one cylinder positioned to open into said exhaust passageway at the other side of said camshaft a set of two push rod means, a first and second fulcrum shaft means, a first set of two cam follower means positioned between a cam and the stem end of one of said two intake or two exhaust valves a second set of two cam follower means positioned between a cam and the stem end of one of said two intake or two exhaust valves on a first fulcrum means a set of two rocker arm means positioned between a second end of said set of two push rods and the stem end of the other one of said two intake or two exhaust valves on a second fulcrum means.

18. The engine defined in claim 17 wherein said first set of two cam follower means further comprises a set of two fulcrum means each having valve end space adjustment means.

19. The engine defined in claim 17 where said set of two rocker arm means each include a valve end space adjustment means.

20. An internal combustion engine including a plurality of cylinders in a row with each cylinder having overhead intake and exhaust valves in a cylinder head, the improvement comprising, a spark plugs positioned in the cylinder head at substantially the center line of each cylinder, the intake and exhaust valves positioned on opposite sides of said spark plug, a single camshaft rotatably mounted in the cylinder head to extend longitudinally on one side of said spark plugs, said camshaft having cams for operating said valves, cam followers pivotally mounted in said cylinder head on the same side of said spark plugs as said camshaft and engaging the cams for operating the valves on the other side of said spark plugs from said camshaft, rocker arms pivotally mounted in said cylinder head on the opposite side of said spark plugs from said camshaft for engaging and operating the valves on that side, and means extending between and engaging each said cam follower and rocker arm for operating the valve engaged by said rocker arm in response to said cam engaged by said cam follower.

* * * * *